United States Patent [19]

Marks et al.

[11] Patent Number: 4,955,829

[45] Date of Patent: Sep. 11, 1990

[54] FANNING STRIP MEMBER AND TERMINAL BLOCK MEMBER ARRANGEMENT

[75] Inventors: Robert J. Marks, Carpentersville; Albert Kupferschmidt, Highland Park, both of Ill.

[73] Assignee: Northern Telecom Limited, Montreal, Canada

[21] Appl. No.: 397,955

[22] Filed: Aug. 23, 1989

[51] Int. Cl.[5] ..... H01R 9/24

[52] U.S. Cl. ..... 439/719; 439/713

[58] Field of Search ..... 379/328; 174/72 A; 361/426, 428; 439/708, 709, 712, 713, 717, 719, 722, 723, 725

[56] References Cited

FOREIGN PATENT DOCUMENTS

| | | | |
|---|---|---|---|
| 1937151 | 2/1971 | Fed. Rep. of Germany | 439/709 |
| 2645325 | 4/1977 | Fed. Rep. of Germany | 439/717 |
| 972773 | 10/1964 | United Kingdom | 174/72 A |

*Primary Examiner*—Eugene F. Desmond
*Assistant Examiner*—Walter G. Hanchuk
*Attorney, Agent, or Firm*—Foley & Lardner, Schwartz, Jeffery, Schwaab, Mack, Blumenthal & Evans

[57] ABSTRACT

An arrangement of fanning strip and terminal block having mutually engageable interlocking structures which allow for mounting of the fanning strip upon and disconnection of the fanning strip from the terminal block from one side of the terminal block only. In practical constructions, the interlocking structures are rails and complementary slots. These may be of any suitable cross-section, e.g. L-shaped or dovetail shaped.

10 Claims, 2 Drawing Sheets

FANNING STRIP MEMBER AND TERMINAL BLOCK MEMBER ARRANGEMENT

This invention relates to fanning strip member and terminal block member arrangements.

In the telecommunications industry, it is conventional for individually insulated telecommunication conductor wires to be connected to other wires at terminal blocks (referred to herein as terminal block members). Such terminal block members may be designed for connecting one incoming conductor wire with an outgoing conductor wire or for the purpose of making multiple connections at each of a plurality of terminal positions. It is also conventional to provide means for corralling groups of individually insulated conductor wires as they approach the terminal block members partly for the sake of neatness, but also to simplify the connection procedure and any subsequent changes in electrical connections which may be required. For the purpose of controlling or corralling the conductor wires, a fanning strip (referred to herein as fanning strip member) is conventionally used together with at least one grooming ring provided with a grooming space for accommodating groups of wires. The fanning strip member and the grooming ring are normally attached to one side of a terminal block member. It is also normally conventional for the fanning strip member to be attached to the terminal block member by an additional or separate locking means such as screw threaded means or clips. While these locking means provide an adequate securing function of the two members together, they are nevertheless inconvenient in that they result in additional individual parts which need to be assembled together to make the complete construction.

The present invention provides a fanning strip member and terminal block member arrangement which seeks to avoid the requirement for separate locking means to assemble the two members together.

Accordingly, the present invention provides a fanning strip member and terminal block member arrangement comprising a terminal block member having a first side with terminal mounting positions for electrical conductor wires, a second and opposite side for engagement with a terminal block support member, and a third side extending between the first and second sides, and a fanning strip member for location along the third side of the terminal block member, the fanning strip member and said third side having mutually engageable interlocking means for mounting the fanning strip member on said third side with the fanning strip member being detachable from the terminal block member solely by movement of the fanning strip member in the direction of the second side.

In general, the mutually engageable interlocking means comprises complementary projections and slots with the projections movable along the slots. The projections and slots are provided upon the two members so as to be interengageable when the two members are assembled together.

Preferably, the projections are provided upon the fanning strip member as this allows the thickness of the fanning strip member to be minimized apart from at the projections. In this case the slots are provided on the third side of the terminal block member.

The or each projection is conveniently in the form of a rail which extends from the appropriate member (preferably the fanning strip member) and is movable progressively into a complementary rail receiving slot in the other member for mounting purposes. It is essential that movement of the fanning strip member in a mounting direction is limited so as to prevent the fanning strip member from being removed from the first side of the terminal block member. This limitation may be provided by either tapering both the rail and the complementary slot so that movement stops upon engagement of the tapering surfaces or, alternatively, providing a termination for the slot providing it with a blind end against which the rail must abut.

The structure of the invention has the advantage that with the fanning strip member mounted in position, when the terminal block member has been mounted upon a support member then the fanning strip member cannot be removed but is securely locked in place.

Embodiments of the invention will now be described by way of example, with reference to the accompanying drawings, in which.

Figure 3:
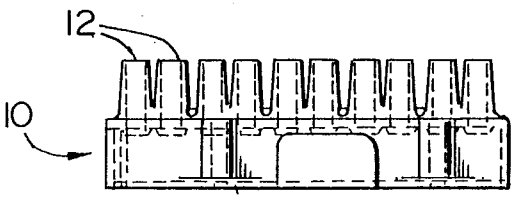
FIG. 3 is a side view of the terminal block member in the direction of arrow III in FIG. 2.
Figure 5:
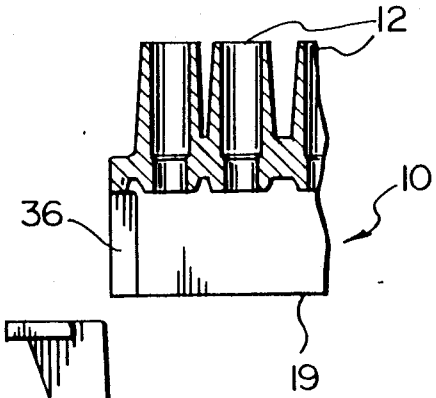
Figure 7:
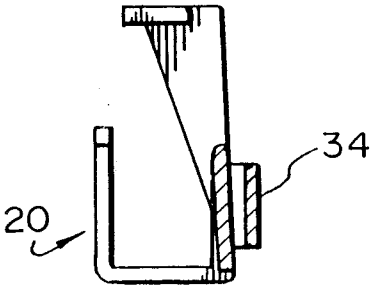
Figure 7:
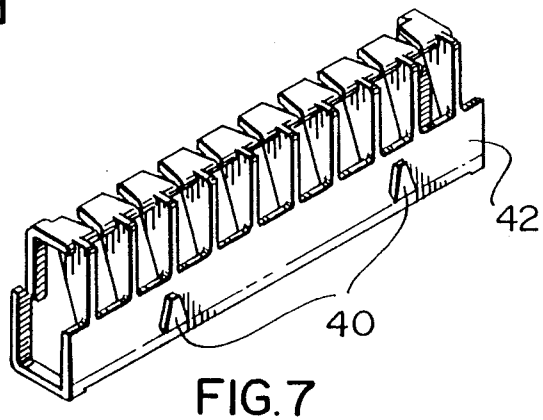
Figure 4:
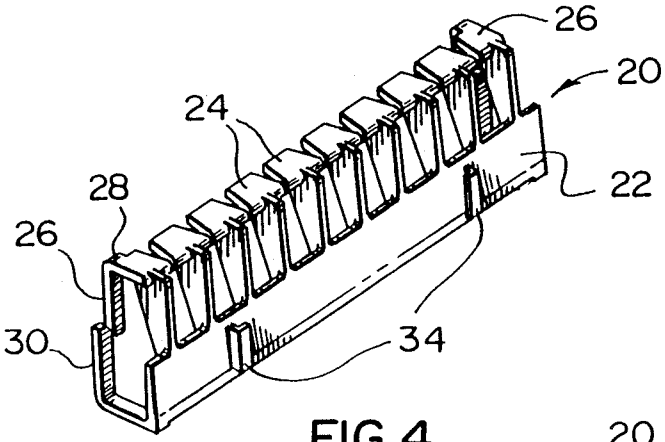
FIG. 4 is an isometric view of the fanning strip member.
Figure 6:
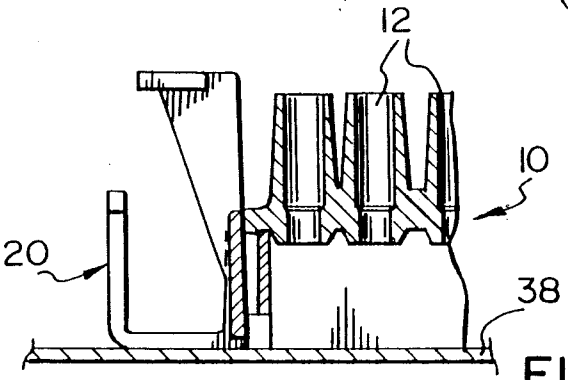

FIG. 5, to a larger scale than FIG. 4, is a side elevational view partly in cross-section, of the fanning strip and terminal block members, to show the direction of movement of the fanning strip member during assembly of the members;

FIG. 6 is a similar view to FIG. 5 and shows the complete assembly of the members with the terminal block member mounted upon the wall of a terminal block support member; and FIG. 7 is a view similar to FIG. 3 of a fanning strip member forming part of a fanning strip member and terminal block member arrangement of a second embodiment.

Figure 1:
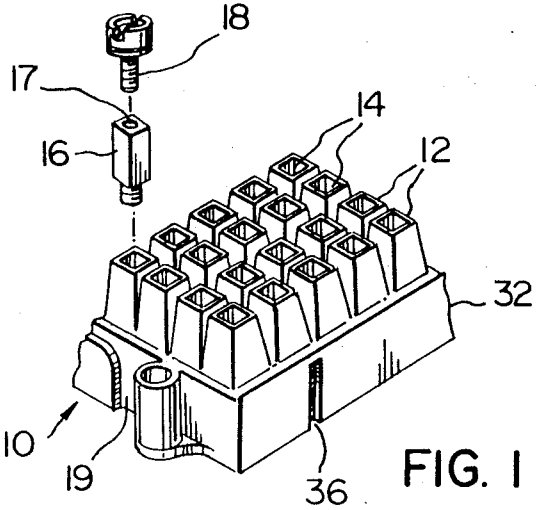
FIG. 1 is an isometric view of a corner region of a terminal block member forming part of an arrangement according to a first embodiment.

As shown in FIG. 1, in an arrangement according to a first embodiment, a terminal block member 10 has a first side having terminal mounting positions provided by a plurality of terminal posts 12 arranged in parallel rows in two directions. The terminal posts 12 have substantially square section apertures 14 for non-rotatably retaining square section terminal post inserts 16. The inserts 16 (one only of which is shown) have screw threaded holes 17 for accommodating terminal screws 18 used for electrically connecting bared ends of electrical conductors (not shown) assembled around the screws and clamped against the post inserts. A second or opposite side of the terminal block member has a planar edge surface 19 (FIG. 3) for overall contact with a wall of a terminal block housing, as will be described.

Figure 2:
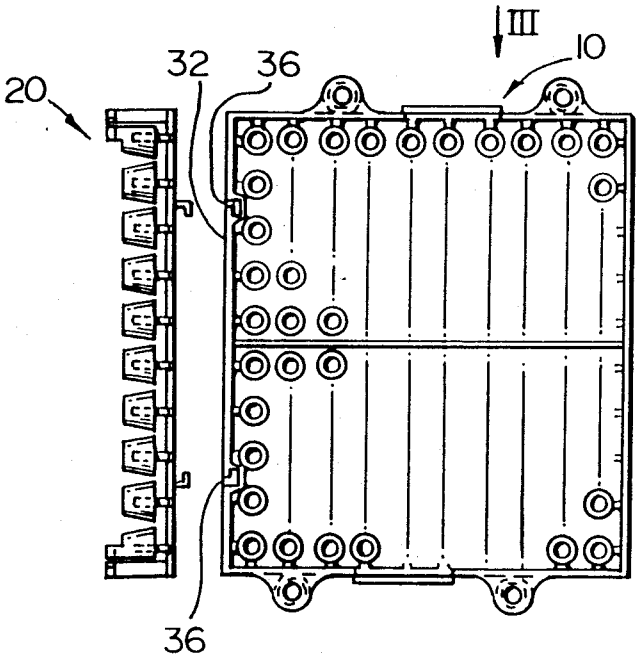
FIG. 2 is an underside plan view, i.e. in the direction of arrow II in FIG. 1, showing the block with a fanning strip member disposed to one side of the block member.

As shown in FIGS. 2 and 4, a fanning strip member 20 is provided to complete the arrangement of the embodiment. As can be seen from FIG. 4, the fanning strip member comprises a substantially narrow plastics molded strip 22 from the one side of which extends a row of spaced apart conductor fanning members 24. At the ends of the row are located two grooming rings 26. The grooming rings 26 are integrally molded with the fanning strip member. Ease of molding is made possible by the design of the grooming rings. Each grooming ring 26 comprises two grooming ring portions 28 and 30 which have ends integral with the strip 22, the portions 28 and 30 being displaced axially of the longitudinal axis of the grooming ring, so as to enable an inside surface of the ring to be accessible for molding from the opposite side of the fanning strip member. With this design, a simple molding apparatus is necessary using two mold halves which are movable vertically together and apart in the view of FIG. 3.

A mutually engageable interlocking means is provided for mounting the fanning strip member onto a third side 32 (FIGS. 1, 2 and 5) of the terminal block member. The mutually engageable interlocking means generally comprises two projections and corresponding complementary slots in the two members. More specifically, the mutually engageable interlocking means comprises two longitudinally spaced rails 34 on the strip 22, the rails being of L-shaped cross-section as can be seen from FIG. 4, and being secured by one leg of each rail to the strip so as to extend laterally of the longitudinal direction of the strip. The interlocking means also comprises two L-shaped slots 36 formed in the side 32 of the terminal block member, each of the slots being of complementary shape to a respective rail 34. As is clear from FIGS. 5 and 6, each of the slots 36 extends upwardly from the second side of the terminal block member and terminates in a position spaced from the first side (i.e. with the terminal posts 12).

In the assembly of the two members together, it is necessary to insert the fanning strip member in the upwards direction, as shown in FIG. 5, onto the terminal block member so as to enable the rails 34 to engage within and progressively slide along the slots 36 from the second side of the terminal block member. The mounting movement of the fanning strip member terminates when the rails 34 engage the blind ends of the slots 36. This is the position shown in FIG. 6 when the lower surface of the fanning strip member lies substantially in planar alignment with the planar edge surface 19 of the terminal block member. The assembly may then be secured to a terminal block support member such as a wall 38 of a terminal block housing. In its mounted position, the terminal block member has its surface 19 with the openings to the slots 36 engaged with the wall 38. Hence, in the mounted position upon the wall 38 it is impossible for the fanning strip member to be removed from the assembly.

It follows therefore that in the embodiment, the fanning strip member is held securely in position upon the terminal block member by the mutually engaging interlocking means with the wall 38 preventing the detachment of the fanning strip member. Hence, individual locking devices such as screws or clamps are unnecessary.

In the above embodiment, the slots 36 terminate at a position spaced from the first side of the terminal block member to prevent removal in that direction of the fanning strip member. However, as an alternative, the rails 34 may be tapered upwardly (not shown) so as to engage and interlock with tapered sides of complementary slots in the terminal block member so as to prevent further upward movement of the fanning strip member.

The rails and complementary shaped slots are not necessarily of the shape described in the first embodiment. For instance, in a second embodiment, the rails 40 of a fanning strip member 42 may be of dovetailed cross-section as shown in FIG. 7 for insertion into complementary dovetailed slots (not shown) in the terminal block member. As in the case of the first embodiment the slots may terminate in a position spaced from the first side of the member or, alternatively, the dovetail rails and slots may be tapered towards their upper ends as shown by FIG. 7.

What is claimed is:

1. A fanning strip member and terminal block member arrangement comprising a terminal block member having a first side with terminal mounting positions for electrical conductor wires, a second and opposite side for engagement with a terminal block support member, and a third side extending between the first and second sides, and a fanning strip member for location along the third side of the terminal block member, the fanning strip member and said third side having mutually engageable interlocking means for mounting the fanning strip member on said third side with the fanning strip member being detachable from the terminal block member solely by movement of the fanning strip member in the direction of the second side.

2. An arrangement according to claim 1 wherein the mutually engageable interlocking means comprises at least one rail extending from the fanning strip member and a rail receiving slot in the third side of the terminal block member, the rail and slot orientated to receive the rail into the slot progressively as the fanning strip member is mounted onto said third side in a direction from the second side towards the first side of the terminal block member, the fanning strip member being limited in its movement in the mounting direction.

3. An arrangement according to claim 2 wherein the rail and slot are both tapered along their lengths to permit insertion of the rail into the slot until the tapering surfaces of the rail interlockingly engage tapering surfaces of the slot.

4. An arrangement according to claim 3 wherein the slot extends upwardly from the second side towards the first side and terminates in a position spaced from the first side.

5. An arrangement according to claim 2 wherein the or each rail is L-shaped in cross-section and is integrally attached to the fanning strip member by one leg of the rail.

6. An arrangement according to claim 2 wherein the or each rail is of dovetail cross-section.

7. An arrangement according to claim 1 wherein the mutually engageable interlocking means comprises at least one rail extending from one of the members and a complementary shaped rail receiving slot in the other member, the rail and slot orientated to receive the rail into the slot progressively as the fanning strip member is mounted onto said third side in a direction from the second side towards the first side of the terminal block member, the fanning strip member being limited in its movement in the mounting direction.

8. An arrangement according to claim 7 wherein the rail and slot are tapered along their lengths to permit insertion of the rail into the slot until the tapering surfaces of the rail engage tapering surfaces of the slot.

9. An arrangement according to claim 7 wherein the or each rail is L-shaped in cross-section and is integrally attached to the fanning strip member by one leg of the rail.

10. An arrangement according to claim 7 wherein the or each rail is of dovetail cross-section.

* * * * *